United States Patent [19]

Bates

[11] Patent Number: 4,679,352

[45] Date of Patent: Jul. 14, 1987

[54] HARDWARE FOR MOUNTING A WINDOW SASH

[75] Inventor: Wayne C. Bates, Rockford, Ill.

[73] Assignee: Amerock Corporation, Rockford, Ill.

[21] Appl. No.: 866,237

[22] Filed: May 22, 1986

[51] Int. Cl.[4] ..... E05D 15/52

[52] U.S. Cl. ..... 49/192; 49/252

[58] Field of Search ..... 49/250, 252, 192, 193, 49/177–180, 247, 187, 188

[56] References Cited

U.S. PATENT DOCUMENTS

| | | | |
|---|---|---|---|
| 3,447,265 | 6/1969 | Weber | 49/192 |
| 3,911,621 | 10/1975 | McHeffen | 49/192 |
| 4,339,892 | 7/1982 | Ulbricht et al. | 49/192 |

FOREIGN PATENT DOCUMENTS

| | | | |
|---|---|---|---|
| 563516 | 6/1975 | Switzerland | 49/192 |

*Primary Examiner*—Kenneth Downey

*Attorney, Agent, or Firm*—Leydig, Voit & Mayer, Ltd.

[57] ABSTRACT

A window sash in mounted in a window frame by hardware which permits the sash to swing open (1) in an egress mode about an upright axis located closely adjacent one upright side of the frame (2) in a wash mode about an upright axis located near the lateral center of the frame or (3) in an awning mode about a horizontal axis located adjacent the upper side of the frame. All that need be done to change the mode of opening is to switch the position of a single selector lever.

11 Claims, 30 Drawing Figures

3
3
2
2
18
18
15
15
82
39
43
36
40
41
47
44
35
45
105
46
37
38
42
51
50
49
67
66
39
55
35
54
38
53
68
184
51
67
64
56
58
65
61
98
60
151
98
150
95
44
42
49
52
45
36
50
35
81
39
82
80
162
163
178
69
79
160
78
176
173
103
96
153
74
103
152
44
75
45
36

6
6
5
5
82
43
36
41
38
35
45
105
44
54
51
42
67
66
68
184
65
61
151
56
58
60
150
95
98
127
49
50
39
81
80
78
69
79
162
176
173
153
103
75
74
152
96

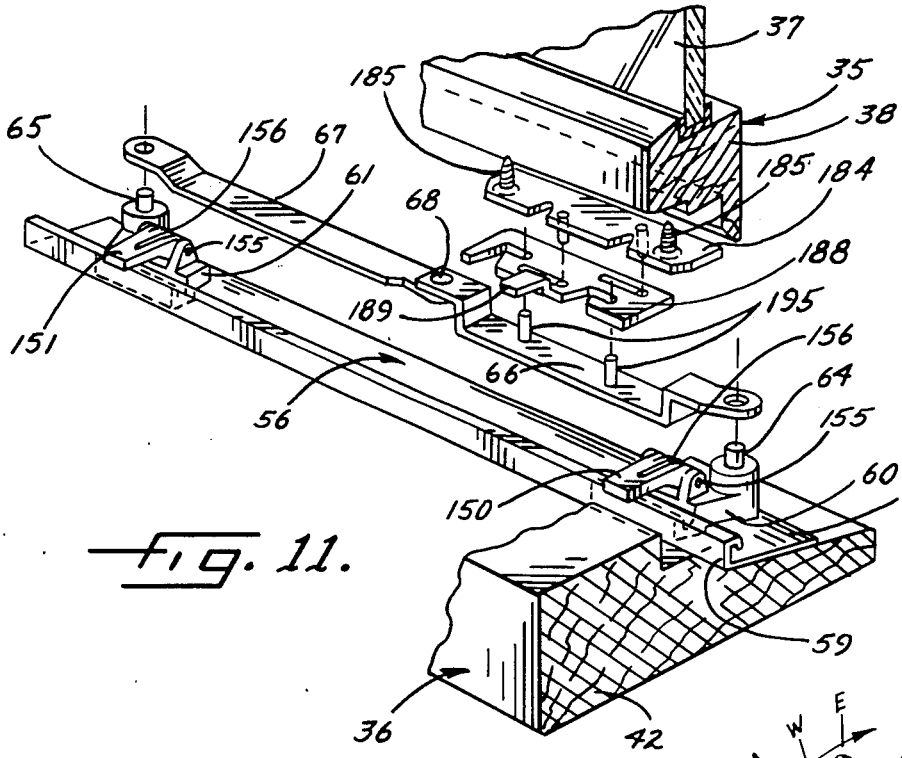
Fig. 11.
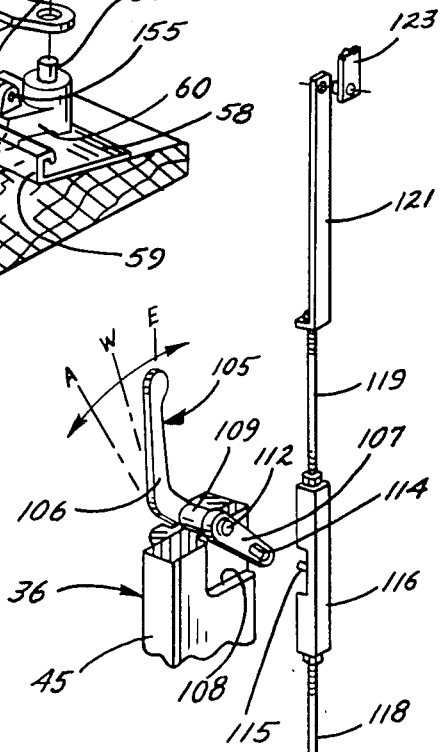
Fig. 12.
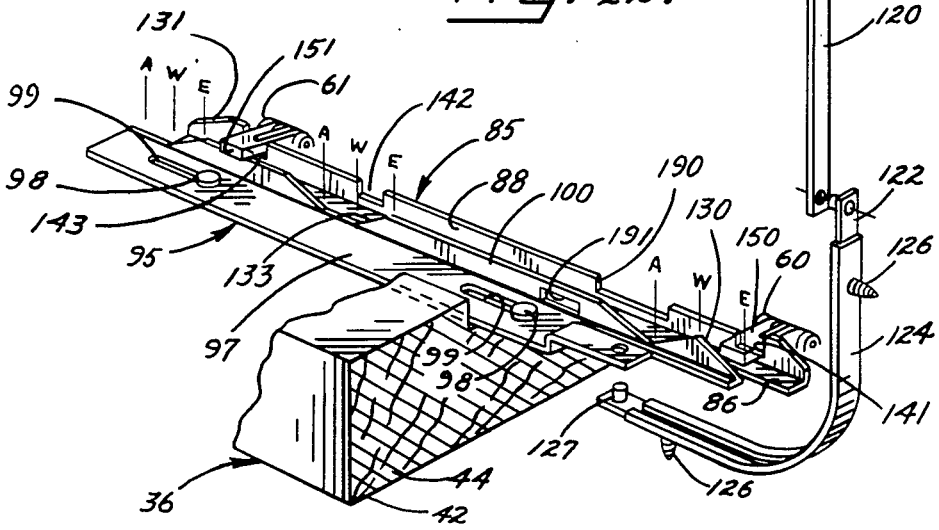

HARDWARE FOR MOUNTING A WINDOW SASH

BACKGROUND OF THE INVENTION

This invention relates generally to hardware for mounting an upright window sash to swing between closed and open positions in a window frame.

Swingable window sashes generally fall into two categories. One is an awning-type sash which is supported to swing between closed and open positions about a generally horizontal pivot axis which is usually located adjacent the upper sides of the sash and the frame. When the sash is swung outwardly about the pivot axis, the lower portion of the window is opened to vent fresh air into the room while the downwardly inclined sash serves as an awning to shed rain and to keep the rain from having a clear path to enter the room through the window.

Another type of swingable window sash is a casement sash which is supported to swing between closed and open positions about an upright axis located near one upright side of the sash. Conventionally, the pivot axis is also located near the adjacent upright side of the window frame so that, when the sash is swung from its closed position through 90 degrees or more, it extends outwardly from the side of the frame and leaves virtually the entire area of the window opening completely unobstructed. A completely unobstructed window opening is desirable not only from the standpoint of improving the view through the opening but also to permit persons to have clear egress through the opening in the event of an emergency condition in the room.

Some casement window sashes have the capability of being located in a position to enable both sides of the window pane to be easily washed from inside the room. This is effected by causing the pivot axis of the sash to shift laterally toward the center of the frame as the sash is opened so that both sides of the pane of the open sash are accessible through the window opening.

One type of casement window sash has the capability of being selectively located either in a normal egress position or in a wash position. In order to convert such a sash between positions, it is necessary to open the sash, to manually adjust the window supporting hardware at both the top and bottom of the window and then to manually move the window between the egress and wash positions.

SUMMARY OF THE INVENTION

One aim of the present invention is to provide new and improved window supporting hardware which selectively permits a window sash to be opened outwardly either in an awning mode or in a casement mode.

A further object of the invention is to provide window supporting hardware which selectively enables a casement window sash to be opened either to a normal egress position or to a wash position simply by changing the position of a selector and then by opening the sash in the usual manner.

Another object of the invention is to provide window supporting hardware which not only mounts a casement sash for selective movement to egress and wash positions but also allows the same sash to be tilted outwardly to an awning or vent position.

Still another object is to provide such hardware which enables the window to be opened and closed in any mode through the use of a single rotary actuating mechanism.

The invention also resides in the relatively compact, relatively simple and comparatively easy-to-use hardware for achieving the foregoing.

These and other objects and advantages of the invention will become more apparent from the following detailed description when taken in conjunction with the accompanying drawings.

BRIEF DESCRIPTION OF THE DRAWINGS

FIGS. 11 and 12 are fragmentary perspective views primarily showing the parts of the sash mounting hardware associated with the bottom of the window sash and frame.

DETAILED DESCRIPTION OF THE PREFERRED EMBODIMENT

Figure 8:
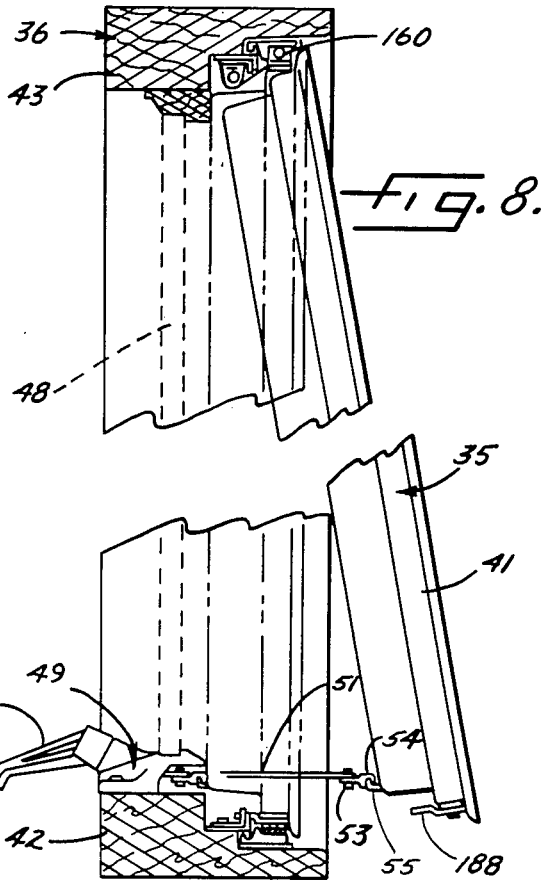
FIG. 8 is an enlarged fragmentary cross-section taken substantially along the line 8—8 of FIG. 7.
Figure 9:
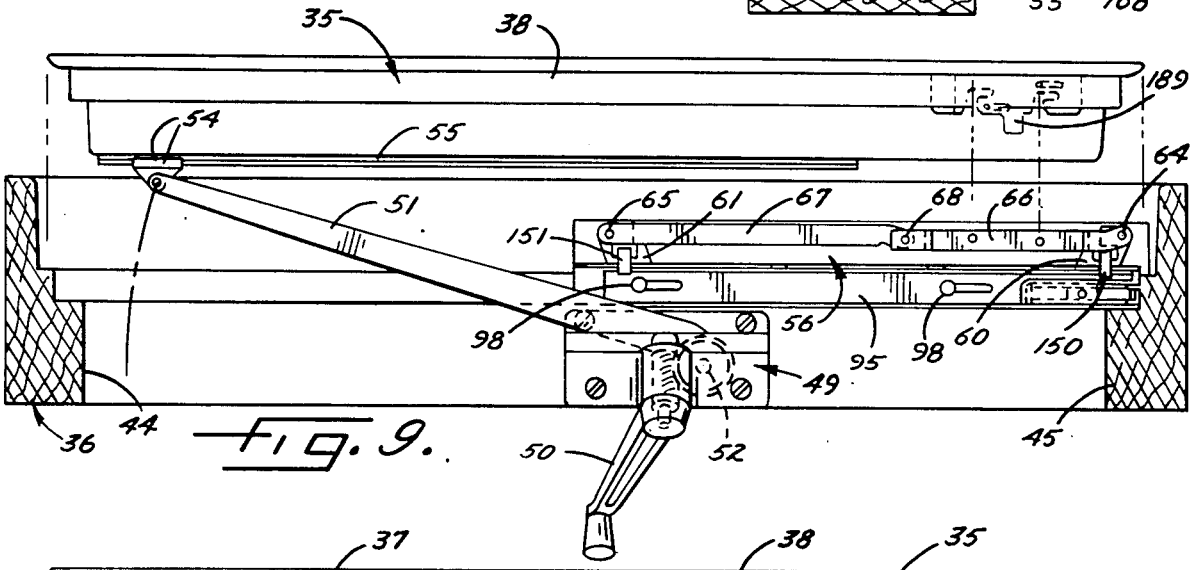
FIGS. 9 and 10 are enlarged cross-sections taken substantially along the lines 9—9 and 10—10, respectively, of FIG. 7.
Figure 10:
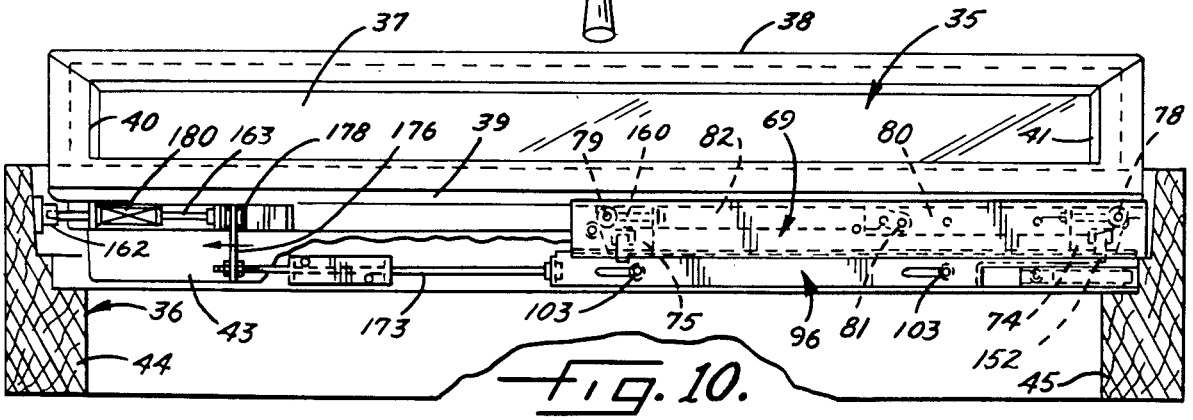

For purposes of illustration, the invention is shown in the drawings as embodied in hardware for mounting a window sash 35 for swinging between closed and open positions in a window frame 36. The sash itself is of conventional rectangular construction and includes a glass pane 37 which is supported by horizontal bottom and top members 38 and 39 and by left and right upright side members 40 and 41. The frame 36 also is rectangular and is defined by a bottom sill 42, by a top header 43 and by left and right side jambs 44 and 45. As is conventional, a latch 46 on the side jamb 44 coacts with a strike 47 on the side member 40 to lock the sash releasably in its closed position. A screen 48 (FIG. 8) is removably positioned in the opening defined by the frame.

Figures 1, 2, 3:
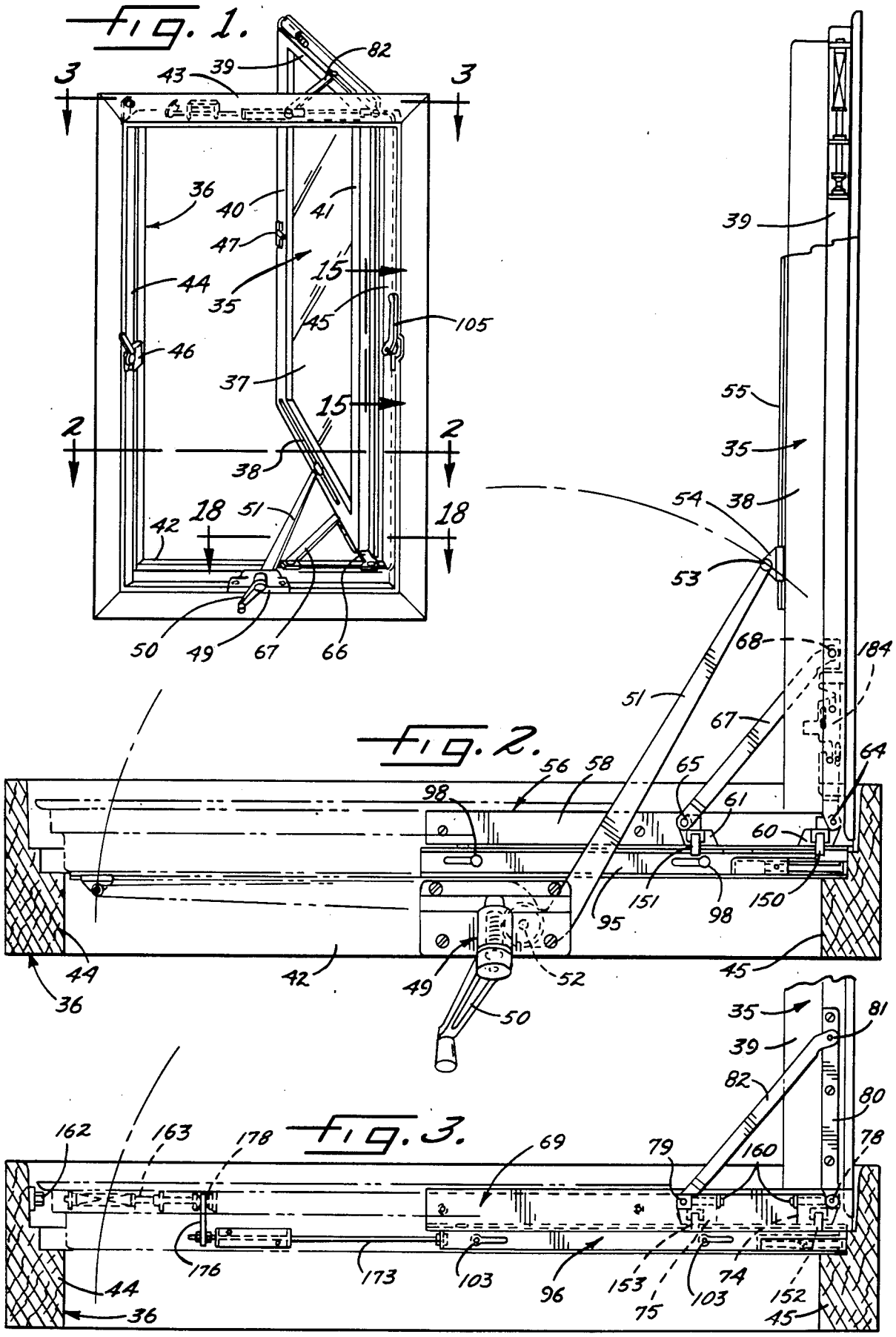
FIG. 1 is a perspective view of a window equipped with new and improved sash mounting hardware incorporating the features of the present invention and shows the sash swung open to a normal egress position.
FIG. 2 is an enlarged cross-section taken substantially along the line 2—2 of FIG. 1.
FIG. 3 is an enlarged fragmentary cross-section taken substantially along the line 3—3 of FIG. 1.

To swing the sash 35 between its closed and open positions, an actuating mechanism 49 (FIG. 2) with a hand crank 50 is supported on the sill 42. When the crank is turned, a lever arm 51 is swung about a pivot 52 within the actuating mechanism and acts to open or close the sash depending upon the direction in which the crank is turned. The outer end of the lever arm is pivotally connected at 53 to a slide 54 which moves horizontally along a horizontal track 55 when the sash is opened and closed, the track being on the bottom member 38 of the sash. If desired, a power-operated actuator of the type disclosed in Lense U.S. Pat. No. 4,553,656 may be used in place of the crank-operated actuating mechanism 49.

In accordance with one aspect of the present invention, the sash 35 is a casement window sash and is supported in the window frame 36 by novel hardware which enables the sash to swing open selectively (1) to a normal egress position about an upright pivot axis located closely adjacent one side of the frame and (2) to a wash position in which the pivot axis is located near the lateral center of the frame, the pivot axis traveling toward the center of the frame automatically as an incident to opening of the sash in the wash mode. When the sash is in its egress position shown in FIGS. 1 to 3, the entire window opening is virtually unobstructed to leave a clear view and to enable use of the window opening as an emergency exit. With the sash in its wash position (see FIGS. 4 to 6), both sides of the window pane 37 are easily accessible for cleaning from inside the room.

Figures 18, 19, 20:
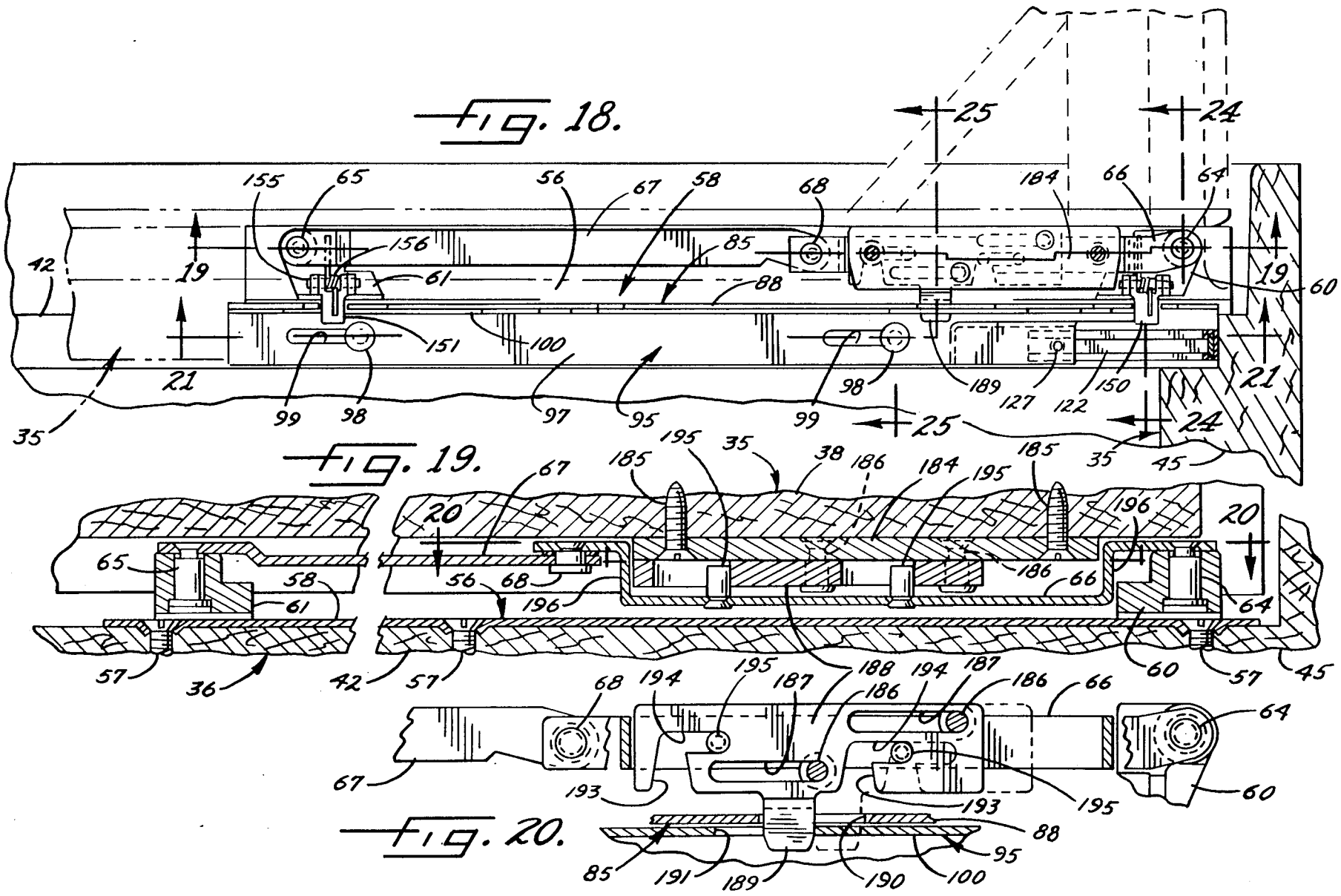
FIG. 18 is an enlarged fragmentary cross-section taken substantially along the line 18—18 of FIG. 1.
FIG. 19 is a fragmentary cross-section taken substantially along the line 19—19 of FIG. 18.
FIG. 20 is a fragmentary cross-section taken substantially along the line 20—20 of FIG. 19.
Figure 24:
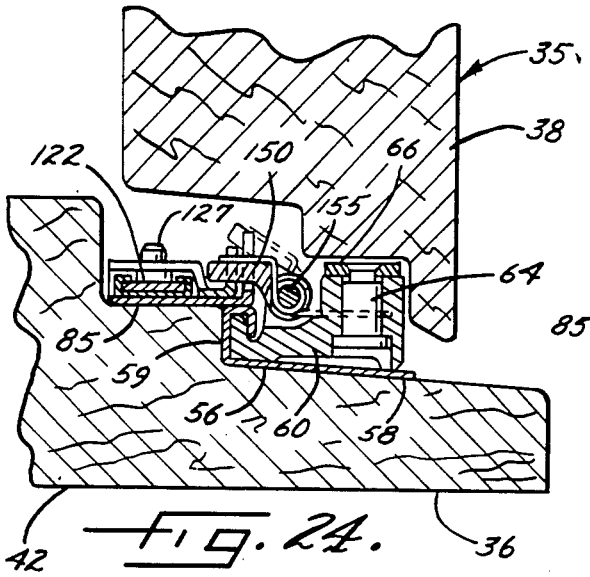
FIGS. 24 and 25 are enlarged fragmentary cross-sections taken substantially along the lines 24—24 and 25—25, respectively, of FIG. 18.
Figure 25:
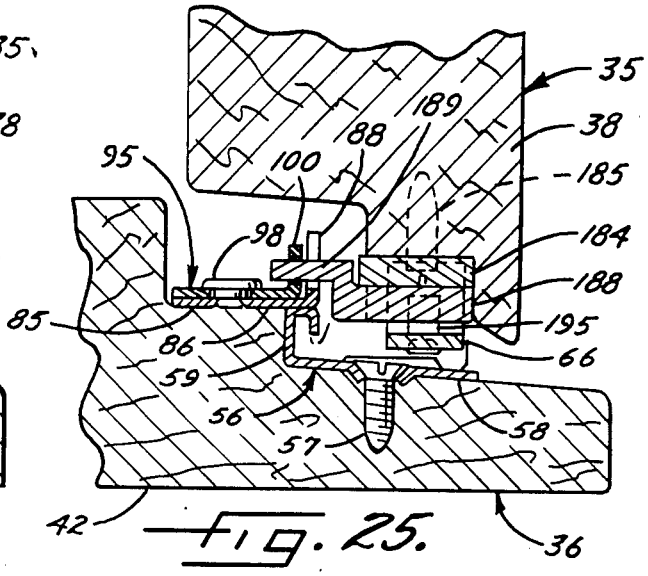

More specifically, the supporting hardware comprises a lower elongated mounting member 56 (FIG. 11) fastened to the top side of the outer ledge of the sill 42 by screws 57 (FIGS. 19 and 25). The mounting member includes a flat plate 58 whose inner margin is bent upwardly, outwardly and then downwardly to define a channel 59 (FIGS. 11 and 24) of inverted J-shaped cross-section along the inner side of the mounting member. As shown in FIG. 11, two shoes 60 and 61 are supported slidably on the plate 58 of the mounting member 56 and are hooked within the channel 59. The channel captivates the shoes against inward and outward movement on the plate 58 while permitting the shoes to slide along the plate and laterally of the frame 36.

Pivot pins 64 and 65 (FIGS. 11 and 19) are carried by and project upwardly from the shoes 60 and 61, respectively. One end of a sash arm 66 is pivotally supported by the pin 60 while one end of a swivel arm 67 is pivotally connected to the pin 61, the free ends of the two arms being connected pivotally to one another by a rivet 68. When the sash 35 is in its egress and wash modes, the sash arm 66 is located directly beneath and is fastened rigidly to the lower member 38 of the sash.

Figure 29:
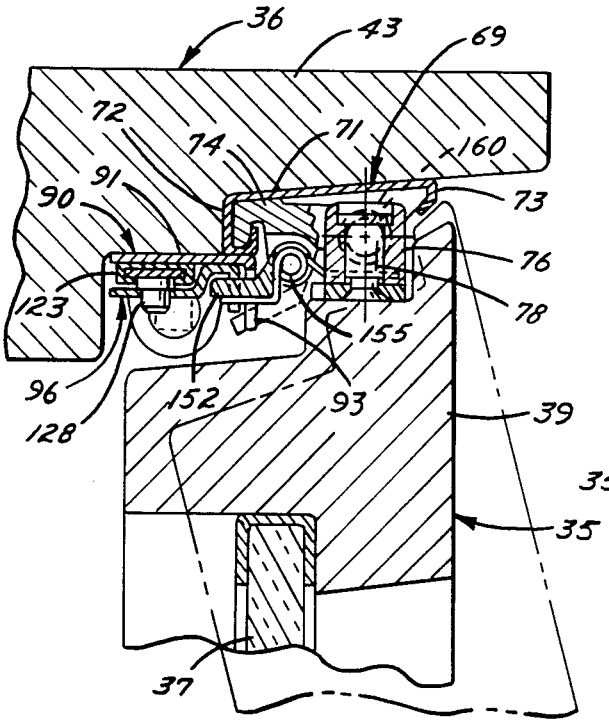
FIGS. 29 and 30 are enlarged fragmentary cross-sections taken substantially along the lines 29—29 and 30—30, respectively, of FIG. 26.
Figures 26, 27, 28:
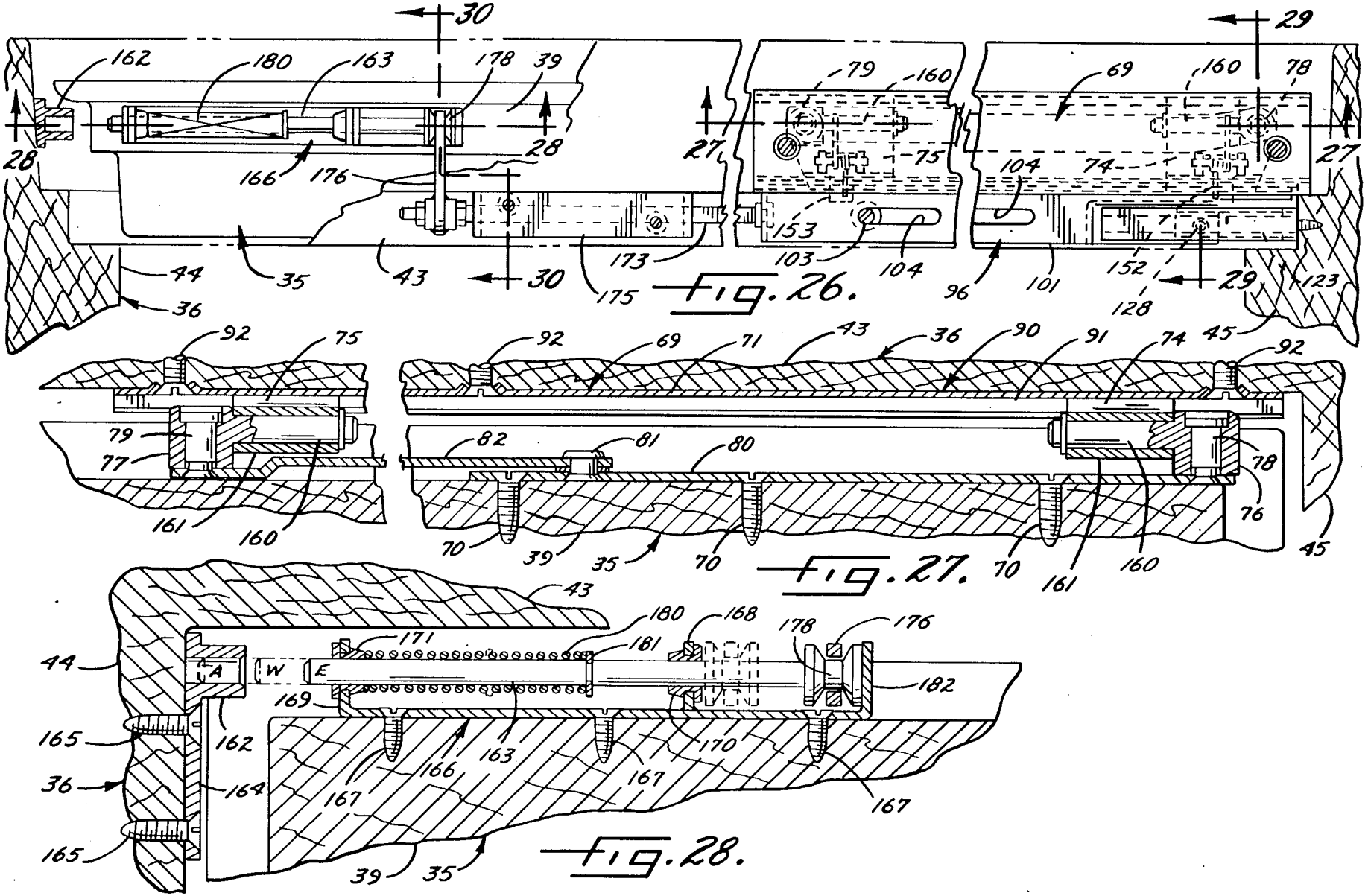
FIG. 26 is an enlarged fragmentary cross-section taken substantially along the line 26—26 of FIG. 14.
FIGS. 27 and 28 are enlarged fragmentary cross-sections taken substantially along the lines 27—27 and 28—28, respectively, of FIG. 26.

An upper elongated mounting member 69 (FIG. 13) which is generally similar to the lower mounting member 56 is secured to the lower side of the outer ledge of the header 43 by screws 70 (FIG. 27). The mounting member 69 includes a flat plate 71 whose inner side is formed with a depending generally J-shaped channel 72 (FIG. 29) and whose outer side is formed with a depending generally C-shaped channel 73. Shoes 74 and 75 are captivated in the channels 72 and 73 against vertical movement and against inward and outward movement but are permitted to slide along the plate 71 and laterally of the window frame 36.

Connected to and movable laterally with the shoes 74 and 75 are blocks 76 and 77 (FIG. 13), respectively, which support pivot pins 78 and 79, respectively. A sash arm 80 is swingably supported at one end by the pivot pin 78 and is connected pivotally at its opposite end by a rivet 81 to one end of a swivel arm 82 whose other end is swingably supported by the pivot pin 79. Screws 83 fasten the sash arm 80 rigidly to the upper member 39 of the sash 35, the sash arm extending along and being located directly above the upper member.

The lower and upper pivot pins 64 and 78 define an upright pivot axis about which the casement window sash 35 may swing as the sash moves between its closed and open positions. When the sash is in its closed position, the swivel arms 67 and 82 are collapsed, are disposed directly below and above the bottom and top members 38 and 39, respectively, of the sash and are located directly in line with the sash arms 66 and 80, respectively. As the sash is swung about the pins 64 and 78 toward its open position, the swivel arms 67 and 82 swing about the pins 65 and 79, respectively, and move outwardly as shown in FIGS. 1 to 6. During such opening of the sash 35, one of the lower shoes 60, 61 moves along the mounting member 56 toward the other lower shoe 60, 61 while one of the upper shoes 74, 75 moves along the mounting member 69 toward the other upper shoe 74, 75 to permit outward swinging of the swivel arms. Conversely, one of the lower shoes moves away from the other lower shoe and one of the upper shoes moves away from the other upper shoe during closing of the sash so as to permit inward swinging of the swivel arms to their collapsed positions.

Figures 21, 22, 23:
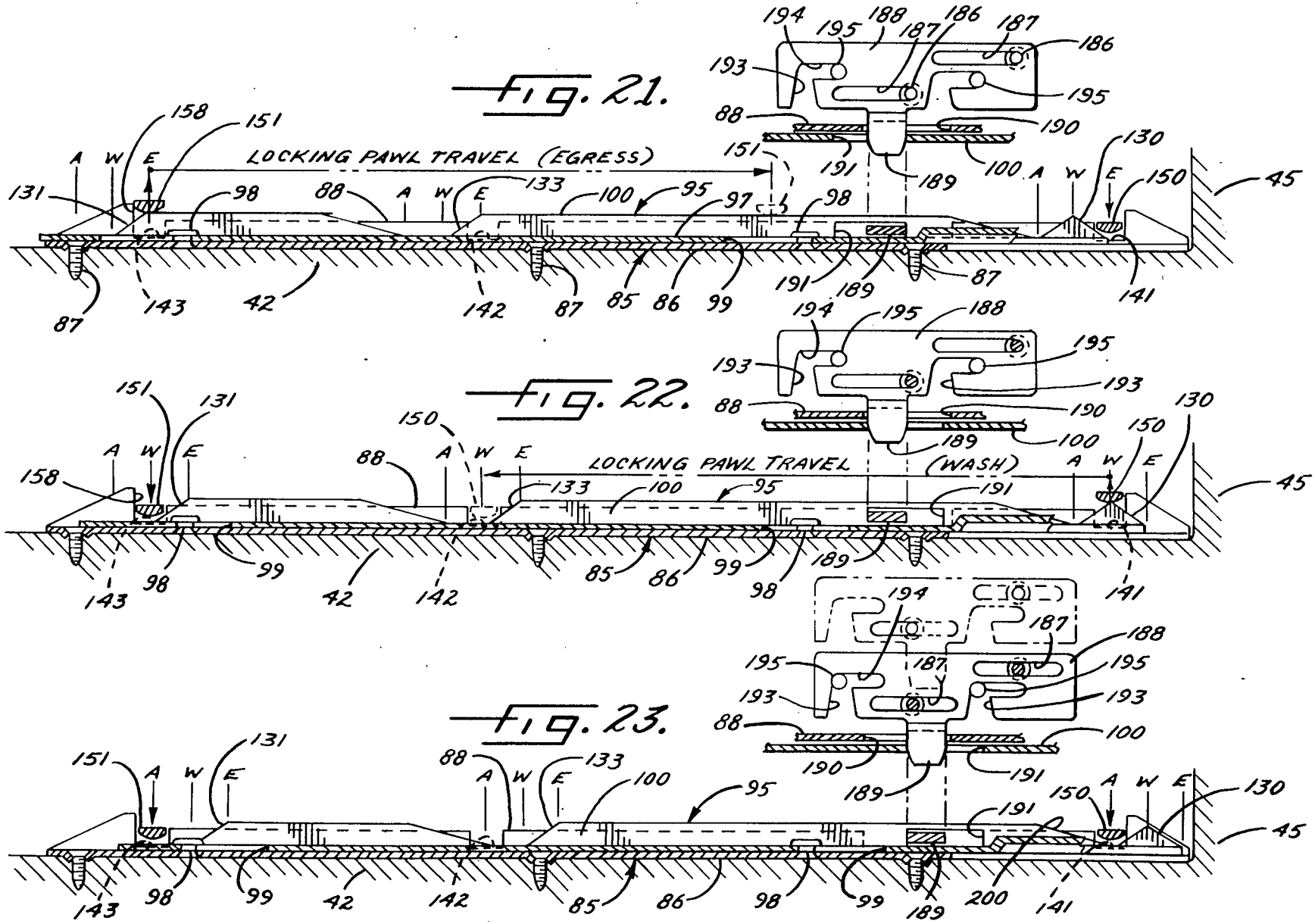
FIG. 21 is a fragmentary cross-section taken substantially along the line 21—21 of FIG. 18 and shows the lower supporting hardware located to cause opening of the sash to the egress position.
FIG. 22 is a view similar to FIG. 21 but shows the lower supporting hardware located to cause opening of the sash to the wash position.
FIG. 23 also is a view similar to FIG. 21 but shows the lower supporting hardware positioned to cause opening of the sash to the awning position.

Extending alongside the inner margin of the mounting member 56 and along the middle ledge of the sill 42 is a generally L-shaped member 85 (FIG. 12) formed with a flat plate 86 which overlies the channel 59 and the top of the sill and which is fastened to the sill by screws 87 (FIG. 21). The member 85 also includes a vertical flange 88 (FIG. 12) formed integrally with and projecting upwardly from the outer margin of the plate 86.

Figures 13, 14:
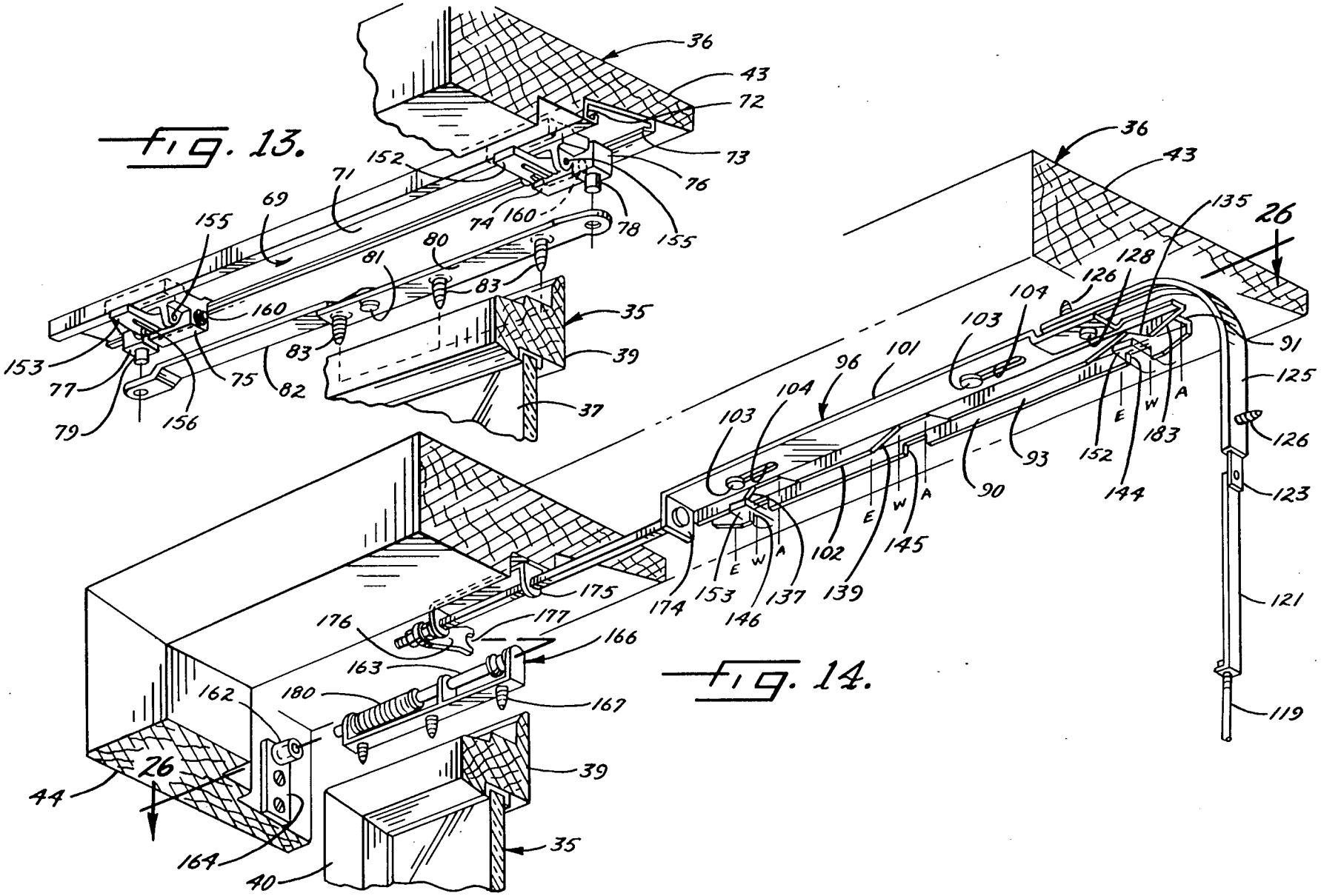
FIGS. 13 and 14 are fragmentary perspective views primarily showing the parts of the sash mounting hardware associated with the top of the window sash and frame.

Another generally L-shaped member 90 (FIG. 14) with a flat plate 91 extends along the middle ledge of the header 43 and alongside the inner margin of the upper mounting member 69, the plate 91 overlying the channel 72 and being fastened to the header by screws 92 (FIG. 26). Formed integrally with the outer margin of the plate 91 is a depending flange 93 (FIG. 14).

Figures 4, 5, 6:
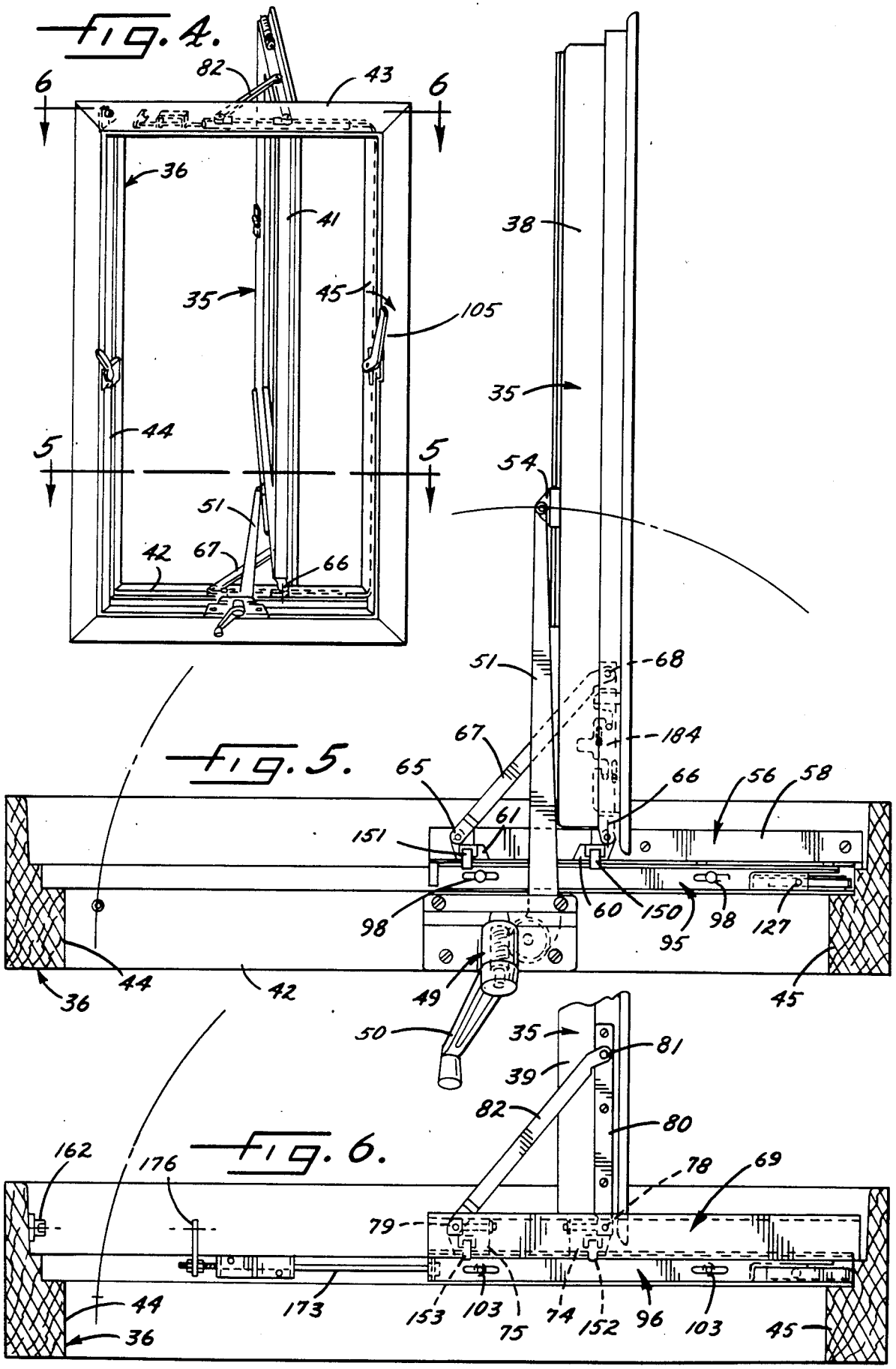
FIG. 4 also is a perspective view of the window and shows the sash swung open to the wash position.
FIG. 5 is an enlarged cross-section taken substantially along the line 5—5 of FIG. 4.
FIG. 6 is an enlarged fragmentary cross-section taken substantially along the line 6—6 of FIG. 4.
Figure 7:
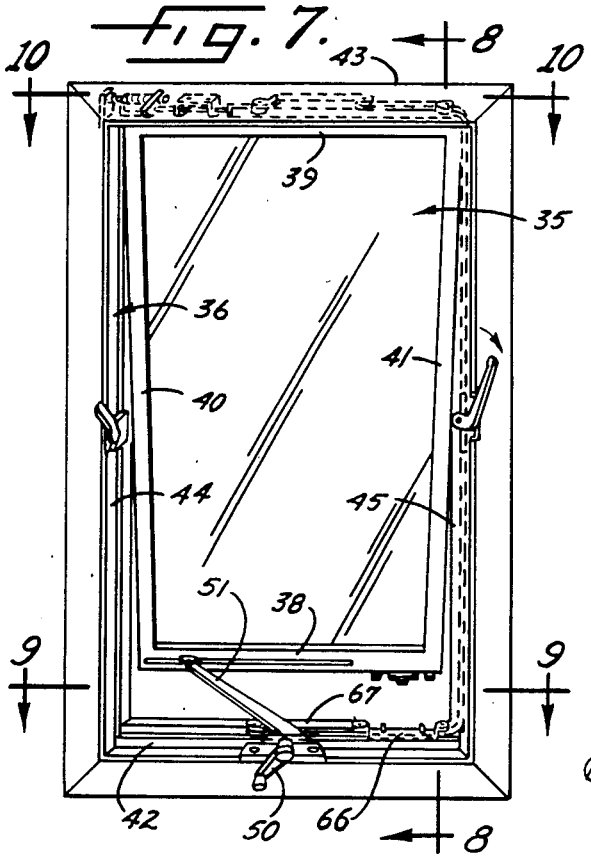
FIG. 7 is another perspective view of the window and shows the sash tilted open to its awning or vent position.

In carrying out the invention, the shoes 60 and 61 and the flange 88 coact with an actuator 95 (FIG. 12) while the shoes 74 and 75 and the flange 93 coact with a similar actuator 96 (FIG. 14) to control the lateral location of the pivot pins 64, 65 and 78, 79 and thus the upright pivot axis of the sash 35. When the actuators 95 and 96 are in one position, the pivot axis is held adjacent the right side member 41 of the sash 35 and the right side jamb 45 of the frame 36 to cause the sash to swing to its egress position (FIGS. 1 to 3) as the sash is opened. When the actuators 95 and 96 are in a different position, the pivot axis travels toward the left side jamb 44 of the frame as the sash is opened and thus is located to effect opening of the sash to its wash position (FIGS. 4 to 6).

More particularly, the lower actuator 95 comprises a flat plate 97 (FIG. 12) which overlies the plate 86 of the member 85. The two plates 86 and 97 are connected by a pair of rivets 98 which extend through elongated slots 99 in the plate 97 so as to mount the actuator 95 for back and forth sliding on the member 85 in a direction laterally of the window frame 36. A flange 100 is formed integrally with and projects upwardly from the outer margin of the plate 97 and extends parallel to the flange 88 in closely spaced face-to-face relation with the inner side of the flange 88.

The upper actuator 96 is generally similar to the lower actuator 95 and includes a flat plate 101 (FIG. 14) with a flange 102 formed integrally with and depending from the outer margin of the plate. The plate 101 underlies the plate 91 of the upper member 90 while the flange 102 extends parallel to the flange 93 in closely spaced face-to-face relation with the inner side of the flange 93. Rivets 103 extend through the plate 91 and through elongated slots 104 in the plate 101 to secure the actuator 96 to the member 90 while permitting the actuator to slide back and forth relative to the member.

Back and forth sliding of the actuators 95 and 96 is effected in response to turning of a mode selector lever 105 (FIG. 12) which herein is supported by the right side jamb 45 of the window frame 36. As shown most clearly in FIG. 12 and FIGS. 15 to 17, the lever includes a handle 106 located on the inboard side of the jamb 45, an oppositely extending arm 107 located in a slot 108 in the jamb 45, and a hub 109 which connects the handle rigidly to the arm. A mounting bracket 110 (FIG. 16) is located in the slot 108, is connected to the jamb 45 by screws 111 and rotatably supports a pin 112 having a square end portion which extends into the hub. A screw 113 extends through the handle 106 and into the hub 109 and is threaded into the pin 112. Accordingly, the pin supports the selector lever 105 to turn relative to the right side jamb 45.

Figure 16:
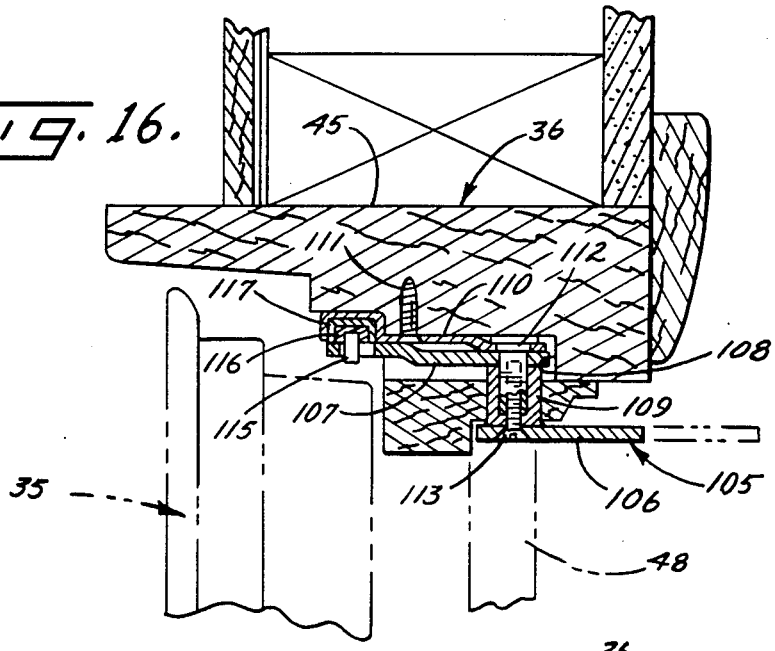
FIGS. 16 and 17 are fragmentary cross-sections taken substantially along the lines 16—16 and 17—17, rspectively, of FIG. 15.
Figure 17:
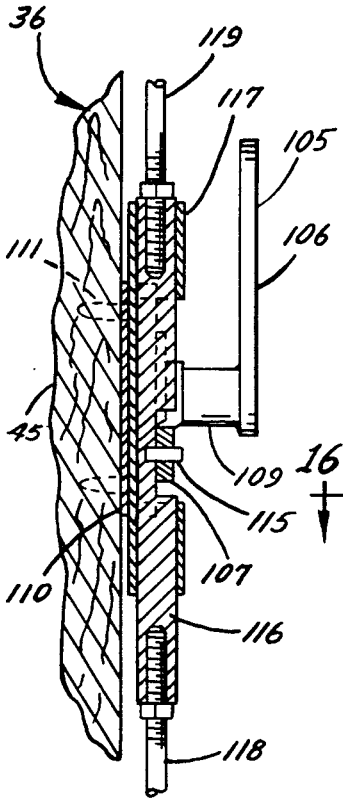
Figure 15:
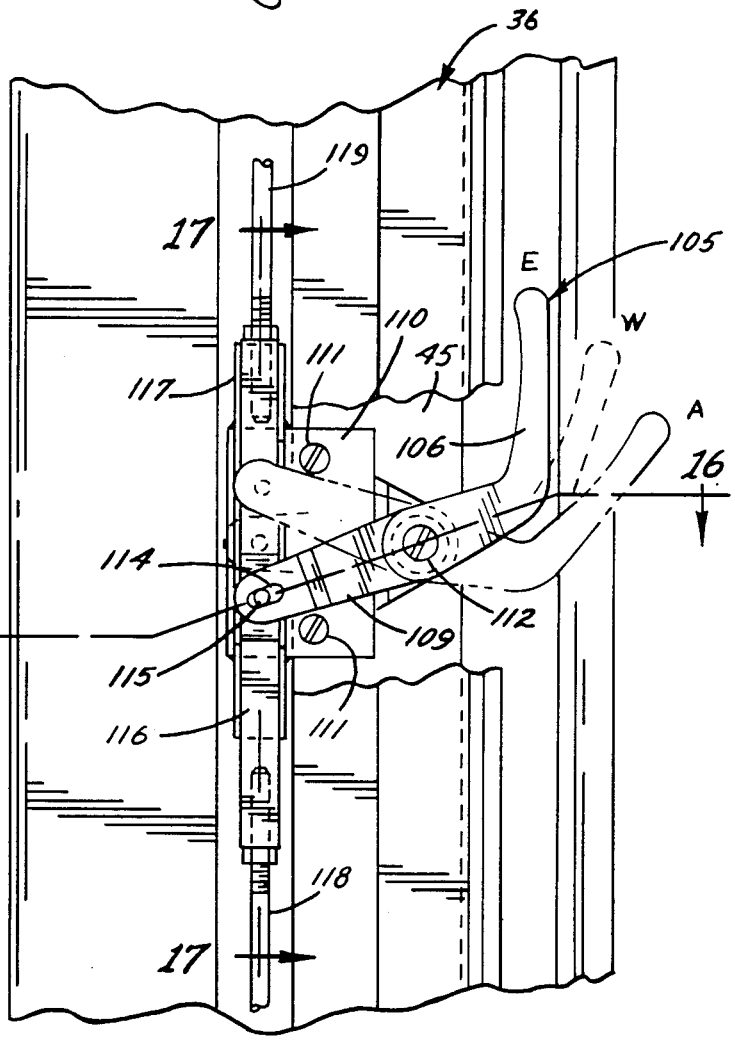
FIG. 15 is an enlarged fragmentary cross-section taken substantially along the line 15—15 of FIG. 1.

The free end of the arm 107 of the mode selector lever 105 is formed with an elongated slot 114 (FIG. 12) which receives a pin 115 on the inboard side of an elongated bar 116. As shown in FIGS. 15 to 17, the bar 116 is supported for vertical sliding within a guide 117 which is welded rigidly to the mounting bracket 110. The bar 116 is shifted upwardly when the lever is turned clockwise (FIG. 15) from an egress position (labeled "E" in the drawings) to a wash position (labeled "W" in the drawings). Counterclockwise turning of the selector lever from the wash position to the egress position effects downward shifting of the bar.

Adjustable tie rods 118 and 119 (FIG. 12) are connected to the lower and upper ends, respectively, of the bar 116 and are secured to lower and upper rigid links 120 and 121. The links 120 and 121, in turn, are connected to laterally flexible but longitudinally stiff elongated straps 122 and 123 which are guided by lower and upper curved sheaths 124 and 125 (see FIGS. 12 and 14) secured to the window frame 36 by screws 126. The lower strap 122 curves downwardly from the right side jamb 45 toward the sill 42 and is connected to the right end of the lower actuator 95 by a pin 127 (FIG. 12). In a similar manner, the upper strap 123 curves upwardly from the right side jamb toward the header 43 and is connected to the right end of the upper actuator 96 by a pin 128 (FIG. 14).

Accordingly, when the selector lever 105 is turned from its egress position to its wash position, the lower actuator 95 is pulled from left-to-right and, at the same time, the upper actuator 96 is pushed from right-to-left. Conversely, reverse turning of the selector lever from its wash position to its egress position effects right-to-left pushing of the lower actuator 95 and left-to-right pulling of the upper actuator 96.

Pursuant to the invention, sliding of the actuators 95 and 96 serves to convert the sash 35 from its egress mode of opening to its wash mode or vice versa. For this purpose, the right end portion of the flange 100 of the lower actuator 95 is formed with a cam surface 130 (FIGS. 12 and 21) which slopes downwardly as it progresses toward the right. In addition, the left end portion of the flange 100 of the lower actuator 95 is formed with a cam surface 131 which slopes downwardly as it progresses to the left. The left central portion of the flange 100 is formed with an upwardly opening and generally V-shaped notch whose right edge 133 defines a cam surface which slopes downwardly upon progressing to the left.

In a somewhat similar manner, the right end portion of the flange 102 of the upper actuator 96 is formed with a downwardly opening and generally V-shaped notch whose right edge defines a cam surface 135 (FIG. 14) which slopes downwardly upon progressing to the right. The left end of the flange 102 is formed with a downwardly opening and substantially V-shaped notch having a left edge 137 which slopes downwardly upon progressing to the left. And, the left central portion of the flange 102 is formed with a generally V-shaped notch whose left edge 139 also slopes downwardly upon progressing to the left.

The flange 88 of the lower member 85 is formed with three upwardly opening and generally V-shaped detent notches 141, 142 and 143 (FIGS. 12 and 21) which are adapted to receive parts on the lower shoes 60 and 61 at various times as will be explained subsequently. In addition, three downwardly opening and generally V-shaped detent notches 144, 145 and 146 (FIG. 14) are formed in the flange 93 of the upper member 90 and are adapted to receive parts on the upper shoes 74 and 75 at various times.

The parts referred to above are detents or pawls 150 and 151 (FIGS. 11 and 12) which are supported by the lower shoes 60 and 61, respectively; there being similar detents or pawls 152 and 153 (FIGS. 13 and 14) supported by the upper shoes 74 and 75, respectively. Each pawl is supported on its respective shoe by a horizontal pivot pin 155 (FIGS. 11, 13, 24 and 29) which enables the pawl to swing upwardly and downwardly relative to the shoe. Torsion springs 156 are operably associated with the pawls and pins and bias the lower pawls downwardly and the upper pawls upwardly.

When the sash 35 is in its closed position and the selector lever 105 is in its egress position, the right lower pawl 150 extends into the detent notch 141 in the member 85, is biased downwardly against the upper side of the channel 59 of the mounting member 56 and is located in close proximity to the cam surface 130 of the actuator 95 (see FIG. 21). The left lower pawl 151 is disposed in close proximity to the cam surface 131 of the actuator 95 and overlies the detent notch 143 in the member 85. When the selector lever is in its egress position, however, the flange 100 of the actuator 95 shields the detent notch 143 as well as the detent notch 142. Accordingly, the pawl 151 is biased downwardly against the upper edge of the flange 100 of the actuator 95 and is prevented from entering the detent notch 143 (see FIG. 21).

As the sash 35 is cranked open with the mode selector lever 105 in its egress position, the right lower pawl 150 remains captivated in the detent notch 141 as shown in FIG. 21 and thus holds the shoe 60 adjacent the right side jamb 45 to keep the right pivot pin 64 and the pivot axis located closely adjacent that side jamb. Accordingly, as the sash is opened, it swings about the pivot axis toward the egress position shown in FIGS. 1 and 2. During such swinging, the pawl 151 and the shoe 61 move from left-to-right toward the position shown in phantom lines in FIG. 21 so as to permit lateral shifting of the left pivot pin 65 and to permit the lower swivel arm 67 to swing outwardly as the sash is opened. As the pawl 151 and the shoe 61 move from left-to-right, the pawl simply travels past the center detent notch 142 in the flange 88 of the member 85 since that notch is shielded by the flange 100 of the actuator 95. During closing of the sash 35 with the selector 105 in its egress position, the pawl 151 and the shoe 61 travel reversely from right-to-left until the sash is fully closed and the pawl 151 reaches the position shown in solid lines in FIG. 21.

To effect opening of the sash 35 to the wash position shown in FIGS. 4 to 6, the mode selector lever 105 is turned from its egress position to its wash position while the sash is in its fully closed position. During such turning, the lower actuator 95 is pulled to the right from the position shown in FIG. 21 to the position shown in FIG. 22. As an incident thereto, the cam surface 130 of the actuator 95 engages the right pawl 150 and cams that pawl upwardly out of the detent notch 141. At the same time, the flange 100 of the actuator 95 moves from beneath the left pawl 151 and allows that pawl to spring downwardly into the detent notch 143 as shown in FIG. 22.

With the pawls 150 and 151 in the positions shown in FIG. 22, cranking of the sash 35 causes the sash to open to its wash position shown in FIGS. 4 to 6. As the sash is opened, the left pawl 151 is captivated in the detent notch 143 and thus is prevented from moving laterally and changing the position of the left pivot pin 65. The pawl 150, however, travels from right-to-left toward the position shown in phantom lines in FIG. 22. The shoe 60 moves with the pawl 150 during such travel and causes the pivot pin 64 and the pivot axis to shift laterally from the right side jamb 45 toward the left side jamb 44. As a result of the shifted pivot axis, the sash 35 opens in the wash mode and toward the wash position shown in FIGS. 4 to 6. When the sash has opened through approximately 90 degrees, the pawl 150 drops into the center detent notch 142 and locks the sash in the open wash position so that the sash will remain rigid and stable while the window pane 37 is being cleaned.

To close the sash 35 from its wash position, the selector lever 105 is returned to its egress position to push the actuator 95 to the left and back to the position shown in FIG. 21. As a result, the pawls 150 and 151 are cammed upwardly out of the detent notches 142 and 143, respectively, by the cam surfaces 133 and 131, respectively, of the actuator. Thereafter, the crank 50 is turned in a direction to close the sash 35 and, as an incident thereto, the pawl 150 travels to the right and snaps downwardly into the detent notch 141 as the sash reaches its fully closed position. As the pawl 150 travels to the right, the pawl 151 bears against a raised portion 158 (FIGS. 21 and 22) of the flange 88 and is prevented from moving to the left. The raised portion 158 is located immediately adjacent the left side of the detent notch 143.

When the lower actuator 95 is shifted between its egress and wash positions by the selector lever 105, the upper actuator 96 is simultaneously moved between egress and wash positions but moves in a direction opposite to the direction of travel of the lower actuator. When the upper actuator 96 is in its egress position, the right pawl 152 is located in and is captivated by the detent notch 144 (see FIG. 14) but the detent notch 146 is shielded by the flange 102 of the actuator. Accordingly, as the sash 35 is opened and closed, the right pawl 152 and the right shoe 74 remain adjacent the right side jamb 45 to keep the upper right pivot pin 78 in vertical alinement with the lower right pivot pin 64 and thereby hold the pivot axis at the right side of the frame 36. The left pawl 153, however, is free to travel laterally and thus permit the upper swivel arm 82 to swing outwardly as the sash is opened and to swing inwardly as the sash is closed.

When the sash 35 is closed and the upper actuator 96 is pushed to the right to its wash position, the right upper pawl 152 is cammed downwardly out of the detent notch 144 by the cam surface 135 and, at the same time, the flange 102 of the actuator 96 shifts clear of the detent notch 146 to enable the pawl 153 to snap into the latter notch. Thus, the pawl 153, the shoe 75 and the pivot pin 79 are locked in place while the pawl 152, the shoe 74 and the pivot pin 78 are free to travel to the left during opening of the sash in the wash mode. When the sash is fully open, the pawl 152 snaps into the center detent notch 145 to hold the sash in place during washing.

Upon shifting of the upper actuator 96 to the left from its wash position to its egress position, the cam surface 139 moves the right pawl 152 downwardly out of the center detent notch 145 while the cam surface 137 moves the left pawl 153 downwardly out of the notch 146. As the sash 35 is closed, the pawl 152, the shoe 74 and the pivot pin 78 travel to the right until the pawl 152 snaps into the detent notch 144 to hold the pivot pin adjacent the right side jamb 45. During travel of the pawl 152, the left side of the pawl 153 engages a depending portion at the left end of the flange 93 adjacent the left edge of the notch 146 and thus is prevented from moving toward the left during closing of the sash.

From the foregoing, it will be apparent that the sash 35 normally opens to the egress position about the upright axis established near the right side jamb 45 by the right pivot pins 64 and 78. Simply by moving the selector lever 105 to the wash position, the right pivot pins are formed to travel toward the left side jamb 44 automatically as an incident to opening the sash while the left pivot pins 65 and 79 are locked in place so as to cause opening of the sash to the wash position. Accordingly, the sash may be switched between the egress and wash modes by doing nothing more than changing the position of the selector lever and then operating the sash in a normal fashion.

In accordance with another aspect of the invention, the sash 35 may be swung open about an upright axis as described above or selectively may be tilted open in an outward direction about a horizontal axis adjacent the upper side member 39 of the sash. When the sash is tilted open about the horizontal axis, the lower end portion of the window opening is vented to allow fresh air to enter the room while the tilted sash serves as an awning to shed rain and to reduce the danger of water entering the room.

To enable the sash 35 to open in an "awning" mode, the two blocks 76 and 77 at the upper side of the sash are formed with elongated and horizontally extending trunnions 160 (FIG. 27). The trunnions extend rotatably through hubs 161 on the outer sides of the shoes 74 and 75 and thus the blocks 76 and 77, the pivot pins 78 and 79 and the upper right hand portion of the sash may pivot relative to the shoes about the horizontal axis established by the trunnions and the hubs.

The upper left-hand portion of the sash 35 is supported to pivot about a horizontal axis established by a bushing 162 (FIG. 28) and by an elongated pivot rod 163 which is adapted to telescope into the bushing. The bushing is supported by mounting plate 164 which is secured by screws 165 to the left side jamb 44 closely adjacent the header 43. A generally V-shaped mounting bracket 166 is secured by screws 167 to the upper side of the upper member 39 of the sash and supports the pivot rod 163. Specifically, the bracket 166 is formed with two ears 168 and 169 fitted with bushings 170 and 171, respectively, which slidably and rotatably receive the pivot rod 163. The latter is alined with the bushing 162 and is also alined with the trunnions 160. When the pivot rod 163 is telescoped into the bushing 162, the two coact with the trunnions 160 to define a horizontal pivot axis across the top of the sash.

Figure 30:
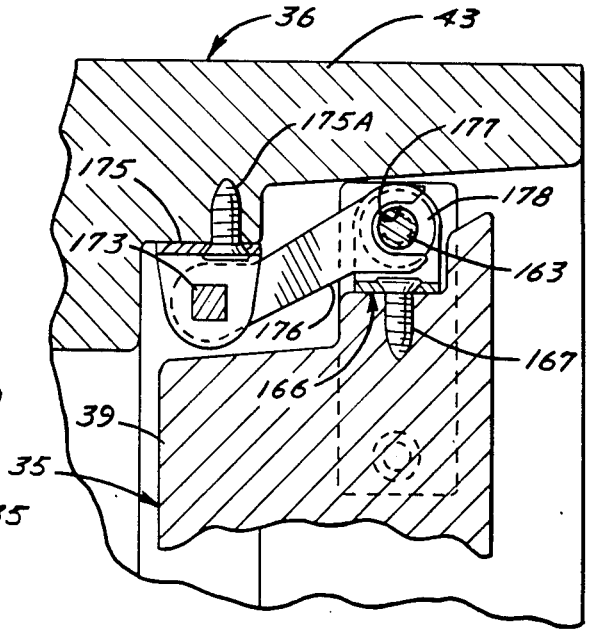

Means are provided for retracting the pivot rod 163 completely out of the bushing 162 when the sash 35 is opened and closed in a casement mode about the upright axis established by the pivot pins 64 and 78. Herein, these means comprise a square control rod 173 (FIGS. 14 and 26) whose right end is fastened securely to a depending ear 174 on the left end of the upper actuator 96. The control rod is guided for lateral sliding by a bracket 175 secured by screws 175A (FIG. 30) to the middle ledge of the header 43. Rotatable with the left end of the control rod is an arm 176 with an outwardly opening notch 177 (FIG. 14) in its outer end. The arm fits within a spool 178 on the right end of the pivot rod 163, a portion of the spool being received within the notch 177.

The selector lever 105 is adapted to be rotated beyond its wash position to an awning position labeled "A" in FIG. 15. As the selector lever is turned to its awning position, the upper actuator 96 is pushed to the left beyond its wash position and acts through the control rod 173, the arm 176 and the spool 178 to slide the pivot rod 163 to the left and into telescoping relation with the bushing 162. As a result, the pivot rod couples up with the bushing to form the horizontal axis coacting with the trunnions 160 to permit outward tilting of the sash 35 in the awning mode.

When the selector lever 105 is returned from its awning position to either its wash position or its egress position, the actuator 96 pulls on the control rod 173 which, in turn, acts through the arm 176 and the spool 178 to retract the pivot rod 163 to the right and out of telescoping relation with the bushing 162. As a result, the pivot rod is free to swing with the sash 35 when the sash is swung open about the pivot pins 64 and 78 in the casement mode. During initial opening of the sash in the casement mode, the spool 178 simply pulls out of the notch 177 in the arm 176 so as to free the spool to swing with the pivot rod 163. As the sash approaches its closed position in the casement mode, the spool 178 moves back into interfitting relation with the alined notch 177.

As shown in FIG. 28, a coil spring 180 is telescoped over the pivot rod 163 and is compressed between the bushing 171 and a washer 181 which is anchored to the pivot rod. When the selector lever 105 is shifted from the egress mode to the wash mode, the arm 176 slides the pivot rod 163 to the left and thereby causes the washer 181 to compress the spring 180. As the sash 35 is opened in the wash mode and the spool 178 moves outwardly from the arm 176, the spring 180 expands and shifts the pivot rod 163 to the right until the spool is stopped by an ear 182 (FIG. 28) on the bracket 166. In this way, the spool 178 is automatically shifted to the proper position to aline with the arm 176 when the sash is closed from its wash position with the selector lever 105 located in its egress position and with the arm located in its far right position as shown in FIG. 28.

When the upper actuator 96 is in its awning position, an inclined surface 183 (FIG. 14) at the right end of the flange 102 underlies the upper right pawl 152 and thus allows that pawl to seat in the detent notch 144. In addition, the notch 137 in the actuator flange 102 moves into alinement with the detent notch 146 so that the pawl 153 may seat in the latter notch. Thus, the pawls 152 and 153 are both prevented from shifting laterally when the sash 35 is opened and closed in its awning mode.

When the sash 35 is in its awning mode, it is necessary to release the lower member 38 of the sash from the lower pivot pins 64 and 65 in order to enable the lower end portion of the sash to swing outwardly about the upper horizontal axis established by the trunnions 160, the bushing 162 and the pivot rod 163. For this purpose, a plate 184 (FIGS. 11 and 19) is secured to the underside of the lower sash member 38 of the sash by screws 185 and carries two downwardly projecting rivets 186 (FIG. 19). The rivets extend through two laterally elongated slots 187 (FIG. 20) in an underlying plate 188 and captivate the two plates in face-to-face relation while permitting the plate 188 to slide laterally relative to the plate 184. The inner edge of the plate 188 is formed with an inwardly extending tongue 189 which, when the sash is closed, projects through an elongated upwardly opening notch 190 in the flange 88 of the member 85 and through an elongated slot 191 in the flange 100 of the lower actuator 95.

Two inwardly opening notches 193 (FIG. 20) are formed in the inner edge of the plate 188 and lead into two laterally extending slots 194 which are formed through the plate 188 adjacent the outer ends of the notches. The slots 194 are sized to slidably receive two laterally spaced pins 195 secured rigidly to and projecting upwardly from the lower sash arm 66 (see FIGS. 19 and 20). The sash arm 66 is formed with an upwardly opening and generally U-shaped central portion having ears 196 disposed closely adjacent the left and right ends of the plate 184. As shown in FIG. 19, the lower plate 188 is substantially shorter than the distance between the ears 196.

When the sash 35 is in its casement mode (either egress or wash), the pins 195 are disposed in the slots 194 and thus lock the plate 188 and the sash to the lower sash arm 66 (see FIGS. 19 to 22). Accordingly, the sash, the sash arm and the plate all pivot outwardly in unison as the sash is opened in the casement mode. During such opening, the tongue 189 on the plate 188 simply pulls out of the notch 190 and the slot 191 in the flanges 88 and 100 and then re-enters the notch and the slot when the sash is closed. When the sash is open in its casement mode, the right and left ends of the plate 184 engage the ears 196 of the sash arm 66 and prevent lateral shifting of the sash.

When the selector lever 105 is turned to its awning position, the lower actuator 95 is pulled to the right past its wash position and, as an incident thereto, the left edge of the slot 191 in the actuator flange 100 engages the tongue 189 of the plate 188 and shifts the plate to the right on the plate 184 from the position shown in FIGS. 21 and 22 to the position shown in FIG. 23. Such shifting of the plate 188 causes the notches 193 in the plate to move into lateral alinement with the pins 195 on the lower sash arm 66 (see FIG. 23). Accordingly, when the sash is swung outwardly about the upper horizontal axis (i.e., about the axis defined by the trunnions 160, the bushing 162 and the pivot rod 163), the plate 188 simply swings outwardly with the sash as shown in phantom in FIG. 23 while leaving the pins 195, the sash arm 66 and the swivel arm 67 remaining in a laterally extending position on the top of the sill 42. This results from the notches 193 slipping outwardly past the pins 195 and frees the lower end of the sash from the pivot pins 64 and 65 attached to the sash arm 66 and the swivel arm 67, respectively. Thus, the lower end portion of the sash is released to swing outwardly in the awning mode.

When the lower actuator 95 is shifted to the right to its awning position, a V-shaped notch 200 (FIG. 23) in the flange 100 of the actuator moves into alinement with the right detent notch 141 to allow the pawl 150 to snap into the detent notch 141. In addition, the cam surface 131 of the actuator 95 moves to the right well clear of the left detent notch 143 so that the pawl 151 may snap into the latter notch. Accordingly, both pawls and their associated shoes 60 and 61 are positively held against lateral shifting when the sash is in its awning mode.

The selector lever 105 is kept in its awning position as the sash 35 is closed by tilting the sash inwardly. During such closing, the tongue 189 re-enters the notch 190 and the slot 191 while the notches 193 pass by the pins 195 on the sash arm 66 to enable the slots 194 to become alined with the pins. If the selector lever is then turned from its awning position to either its wash position or its egress position, the actuator 95 is pushed to the left to cause the right end of the slot 191 to push against the plate 188 and slide that plate to the left. During such sliding, the notches 193 move out of alinement with the pins 195 while the slots 194 re-captivate the pins to latch the plate 188 to the sash arm 66 and permit opening of the sash to either its wash position or its egress position in the casement mode.

To summarize, opening and closing of the sash 35 in the egress mode are both effected while the selector lever 105 is in its egress position. When the lever is so positioned, the upper actuator 96 holds the pivot rod 93 in retracted relation with the bushing 92 so as to free the sash to swing outwardly away from the left side jamb 44, the spool 178 pulling free of the arm 176 during opening of the sash and automatically reconnecting with the arm during closing of the sash. In addition, the plate 188 holds the lower sash arm 66 in latched relation with the sash in order to cause the sash arm to swing in unison with the sash. The pawls 150 and 152 hold the right pivot pins 64 and 78 in fixed positions adjacent the right side jamb 45 while the pawls 151 and 153 free the left pivot pins 66 and 79 to travel toward and away from the pivot pins 64 and 78 during opening and closing of the sash. The spool 178 automatically re-couples with the arm 176 as the sash reaches its fully closed position.

When the selector lever 105 is turned to its wash position, the pivot rod 163 still is held in retracted relation with the bushing 162 but the spool 178 is shifted to the left and the spring 180 is compressed. Upon opening of the sash 35, the spool 178 leaves the arm 176 and, at the same time, the compressed spring 180 shifts the spool back to the right preparatory to closing of the sash. As before, the plate 188 holds the lower sash arm 66 in latched relation with the sash. The pawls 151 and 153 hold the left pivot pin 65 and 79 in a fixed position near the center of the sash while the released pawls 150 and 152 permit the right pivot pins 64 and 78 to travel to the left toward the pivot pins 65 and 79 until the pawls 150 and 152 snap into place in the center notches 142 and 145 to lock the sash rigidly in its open position for washing. Prior to closing the sash from its wash position, the selector lever 105 is returned to its egress position in order to unlock the pawls 150 and 152 and permit closing of the sash. During such closing, the left pawls 151 and 153 and the pivot pins 65 and 79 are held against movement to the left while the pawls 150 and 152 and the pivot pins 64 and 78 travel back toward the right side jamb 45 until the pawls 150 and 152 snap into the notches 141 and 144. Again, the spool 178 automatically re-couples with the arm 176 as the sash reaches its fully closed position.

When the selector lever 105 is turned to is awning position, the pivot arm 163 is pushed into telescoping relation with the bushing 162 and coacts with the trunnions 160 to establish the upper horizontal pivot axis. In addition, the plate 188 is shifted to the left to free the plate and the sash 35 from the lower sash arm 66 and the lower pivot pins 64 and 65 and thereby permit outward tilting of the lower end portion of the sash. After the sash has been closed, the pivot rod 163 is retracted out of the bushing 162 and the sash and the plate 188 are relatched to the sash arm 66 as an incident to moving the selector lever 105 from its awning position to its wash position or its egress position.

Thus, the present invention brings to the art new and improved hardware for mounting a sash 35 for swinging in a casement mode to either an egress position or a wash position and for swinging in an awning mode to a vent position. The mode of opening may be changed simply by switching the position of the selector lever 105 and then opening the sash in a normal manner with the crank 50. Thus, the conversion may be made in an extremely simple manner.

I claim:

1. Hardware for mounting an upright window sash in a window frame, said hardware comprising pivot means supporting said sash to swing between closed and open positions about an upright axis located near one upright side of said sash, and means selectively operable (a) to hold said axis near the adjacent upright side of said frame as said window is swung from said closed position to said open position or (b) to cause said axis to travel toward the other upright side of said frame automatically as an incident to swinging of said sash from said closed position to said open position.

2. Hardware as defined in claim 1 in which said pivot means comprise a pair of laterally spaced upper pivots and further comprise a pair of laterally spaced lower pivots alined laterally with said upper pivots, means supporting each of said pivots to shift laterally of said frame, said selectively operable means comprising detents associated with said pivots and each being movable between a first position permitting lateral shifting of the associated pivot and a second position preventing such lateral shifting, and manually operable actuator means for causing said detents to switch between said first and second positions.

3. Hardware as defined in claim 2 in which said actuator means comprise upper and lower actuators, and means for simultaneously shifting said actuators laterally of said frame.

4. Hardware as defined in claim 2 in which said shifting means comprise a lever connected to said actuators.

5. Hardware as defined in claim 1 further including means for releasably holding said axis fixed in a rigid position after said axis has traveled a predetermined distance from said one upright side of said frame toward said other upright side of said frame.

6. Hardware as defined in claim 1 further including generally horizontally extending pivot means supporting said sash to swing between closed and open positions about a generally horizontal axis located adjacent the upper side of said sash, said selectively operable means being selectively effective to release said sash from said upright axis and to cause said sash to swing about said horizontal axis as said sash is moved between said closed and open positions.

7. Hardware for mounting an upright window sash in a window frame, said hardware comprising upright pivot means supporting said sash to swing between closed and open positions about an upright axis located near one upright side of said sash, means selectively operable (a) to hold said axis near the adjacent upright side of said frame as said window is swung from said closed position toward said open position or (b). to cause said axis to travel toward the other upright side of said frame automatically as an incident to swinging of said sash from said closed position to said open position, generally horizontal pivot means supporting said sash to swing between closed and open positions about a generally horizontal axis located near the upper sides of said sash and said frame, and means selectively operable (a) to release said sash from said horizontal pivot means when said sash is swung about said upright axis and (b) to release said sash from said upright pivot means when said sash is swung about said horizontal axis.

8. Hardware as defined in claim 7 in which said upright pivot means comprise a pair of laterally spaced upper pivots and further comprise a pair of laterally spaced lower pivots alined laterally with said upper pivots, means supporting each of said pivots to shift laterally of said frame, said first-mentioned selectively operable means comprising detents associated with said pivots and each being movable between a first position permitting lateral shifting of the associated pivot and a second position preventing such lateral shifting, and manually operable actuator means for causing said detents to switch between said first and second positions.

9. Hardware as defined in claim 8 in which at least a portion of said upright pivot means is fixed to said frame adjacent one lower corner of the frame and in which at least a portion of said horizontal pivot means is fixed to said frame adjacent the diagonally opposite corner of the frame, said selectively operable means comprising means for selectively coupling said sash to and uncoupling said sash from said portion of said upright pivot means and further comprising means for selectively coupling said sash to and uncoupling said sash from said portion of said horizontal pivot means.

10. Hardware for mounting an upright window sash in a window frame, said sash having inner and outer sides, said hardware comprising first pivot means for supporting said sash to swing outwardly about an upright axis from a closed position to an open position and to swing inwardly about said axis from an open position to a closed position, second pivot means supporting said sash to swing outwardly about a generally horizontal axis from a closed position to an open position and to swing inwardly about said horizontal axis from an open position to a closed position, means selectively operable either to release said sash from said second pivot means while leaving said sash supported by said first pivot means or to release said sash from said first pivot means while leaving said sash supporting by said second pivot means whereby said sash may be swung selectively about either axis, and reversible rotatable actuating means connected to said sash and operable when actuated in one direction to swing said sash outwardly about the selected axis and operable when actuated in the opposite direction to swing the sash inwardly about the selected axis.

11. Hardware as defined in claim 10 in which at least a portion of said first pivot means is fixed to said frame adjacent one lower corner of the frame and in which at least a portion of said second pivot means is fixed to said frame adjacent the diagonally opposite corner of the frame, said selectively operable means comprising means for selectively coupling said sash to and uncoupling said sash from said portion of said first pivot means and further comprising means for selectively coupling said sash to and uncoupling said sash from said portion of said second pivot means.

* * * * *